US006941615B2

(12) United States Patent
Shanor et al.

(10) Patent No.: US 6,941,615 B2
(45) Date of Patent: Sep. 13, 2005

(54) ROTATING OPERATING HANDLE FOR VACUUM CLEANER

(75) Inventors: Michael J. Shanor, Nicholasville, KY (US); Amy N. Mudd, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 0 days.

(21) Appl. No.: 10/829,003

(22) Filed: Apr. 21, 2004

(65) Prior Publication Data

US 2004/0211028 A1 Oct. 28, 2004

Related U.S. Application Data

(60) Provisional application No. 60/465,705, filed on Apr. 26, 2003.

(51) Int. Cl.[7] ..... A47L 9/32
(52) U.S. Cl. ..... 15/410; 15/339; 15/351
(58) Field of Search ..... 15/323, 339, 351, 15/410

(56) References Cited

U.S. PATENT DOCUMENTS 1,862,941 A * 6/1932 Benson ..... 15/336
D152,182 S * 12/1948 Barnhart ..... 15/323
2,600,608 A * 6/1952 Barnhart ..... 15/323
2,653,342 A * 9/1953 Bonin et al. ..... 15/323
2,822,566 A * 2/1958 Eberhart ..... 15/410
3,013,287 A * 12/1961 Descarries ..... 15/410
3,204,272 A * 9/1965 Green et al. ..... 15/410
3,231,922 A * 2/1966 Smith ..... 15/339
3,631,559 A * 1/1972 Gaudry et al. ..... 15/144.1
3,758,914 A * 9/1973 Nupp et al. ..... 15/410
4,670,937 A * 6/1987 Sumerau et al. ..... 15/410
6,260,235 B1 * 7/2001 Leung ..... 15/410
6,345,408 B1 2/2002 Nagai et al.

OTHER PUBLICATIONS

National Brand Model. MC–U19C. Photographs taken Oct. 3, 2003.
National Brand Model MC–U33A. Photographs taken Oct. 3, 2003.
National Brand Model MC–U28C. Photographs taken Oct. 3, 2003.

* cited by examiner

*Primary Examiner*—Theresa T. Snider
(74) *Attorney, Agent, or Firm*—King & Schickli, PLLC

(57) ABSTRACT

A floor cleaning apparatus includes a nozzle assembly and a canister assembly connected to the nozzle assembly. A suction generator and a dirt collection vessel are carried by the nozzle assembly or the canister assembly. In addition, the vacuum cleaner includes a control handle displaceable between operating and storage positions. A stabilizer on the handle is provided adjacent the floor in the storage position. Engagement of the stabilizer with the floor prevents the vacuum cleaner from inadvertently tipping over rearwardly.

22 Claims, 10 Drawing Sheets

ROTATING OPERATING HANDLE FOR VACUUM CLEANER

This application claims the benefit of U.S. Provisional Patent Application Ser. No. 60/465,705 filed on Apr. 26, 2003.

TECHNICAL FIELD

The present invention relates generally to the floor care equipment field and, more particularly, to a floor cleaning apparatus incorporating a control handle assembly that may be pivoted between an operating position in which the apparatus is manipulated to clean a floor and a storage position in which the handle stabilizes the apparatus by engaging the floor and preventing tipping.

BACKGROUND OF THE INVENTION

Upright vacuum cleaners of various shapes and designs have long been known in the art. Upright vacuum cleaners generally include a nozzle assembly including an intake opening, a canister assembly connected to the nozzle assembly, a suction generator for generating the negative air pressure to draw dirt and debris into the vacuum cleaner and a dirt collection vessel in the form of a bag or cup for collecting dirt for disposal.

Generally, upright vacuum cleaners are stored with the canister assembly in a vertical upright position. On many of these devices that means that the upper end of the control handle is perhaps from 1.0 to 1.4 meters above the floor. Accordingly, the handle on an upright vacuum cleaner represents a long lever arm that when bumped or inadvertently jostled tends to promote tipping of the upright vacuum cleaner backward or on its side. Since many vacuum cleaners are stored in closets when not in use long coats and other items may be drug across the handle and result in inadvertent tipping.

The present invention relates to an upright vacuum cleaner with a control handle assembly that may be displaced from an operating position to a relatively compact storage position. In effect the handle assembly folds back over the canister assembly and the tip of the handle functions as a stabilizer that will engage the ground and prevent the vacuum cleaner from tipping over backward. Accordingly, the present invention represents a significant advance in the art.

SUMMARY OF THE INVENTION

In accordance with the purposes of the present invention as described herein, a floor care cleaning apparatus comprises a nozzle assembly having an intake opening, a canister assembly connected to the nozzle assembly, a suction generator and a dirt collection vessel both carried on one of the nozzle assembly and the canister assembly, and a control handle assembly. The control handle assembly is pivotally connected to the canister assembly and includes both an operating handle adjacent one end used when manipulating the floor cleaning apparatus back and forth across the floor during cleaning and a carrying handle adjacent a second end used to carry the apparatus when not in use. As will be described in greater detail below the control handle is selectively displaceable between an operating position and a storage position.

More specifically describing the invention, the floor care cleaning apparatus includes a hub on one of the canister assembly and the control handle assembly and a boss on the other of the canister assembly and the control handle assembly. Further the apparatus includes a first projection on one of the canister assembly and the control handle assembly and a first projection receiver on the other of the canister assembly and the control handle assembly.

The first projection receiver includes a first stop that engages the first projection when the control handle assembly is in the operating position and a second stop that engages the first projection when the control handle assembly is in the storage position. More particularly, the first projection receiver is a groove extending in a limited arc radially around an axis about which the control handle assembly pivots with respect to the canister assembly.

The floor care cleaning apparatus also includes a locking mechanism for locking the control handle in both the operating position and the storage position. The locking mechanism includes a guide track carried on one of the canister assembly and the control handle assembly and a displaceable latch received in the guide track. In addition the apparatus includes a first latch receiver for receiving the latch when the control handle assembly is in the operating position and a second latch receiver for receiving the latch when the control handle assembly is in the storage position. The first and second latch receivers are carried on the other of the canister assembly and the control handle assembly: that is, the structure not carrying the latch. In addition, the apparatus includes a means for biasing the latch into one of the first and second latch receivers.

Still further describing the invention, the apparatus may include a slot carried by the hub and a retaining clip received in the slot to retain the control handle assembly and canister assembly together. Additionally, the apparatus may include a second projection on one of the canister assembly and control handle assembly and a second projection receiver on the other of the canister assembly and control handle assembly. A first rib for engaging the second projection when the control handle assembly is in an operating position and a second rib for engaging the second projection when the control handle assembly is in the storage position are carried on the other of the canister assembly and the control handle assembly. Together, the first and second projections function to limit the pivoting motion of the control handle assembly to an arc of substantially 180 degrees between the operating and storage positions.

The apparatus may also include an aperture in the hub substantially on the pivotal axis of the control handle assembly. An electrical power cord extends through this aperture.

The pivotal axis A of the control handle is spaced a distance $D_1$ from the bottom of the floor cleaning apparatus and the operating handle includes an end or stabilizer spaced a distance $D_2$ from the axis A wherein $D_2$ is less than $D_1$ by about 0.5 to about 2.0 cm. Thus, the tip or stabilizer at the end of the control handle is positioned adjacent to the ground when the control handle assembly is in the storage position. In this position the tip or stabilizer will quickly engage the ground and prevent the tipping of the floor cleaning apparatus rearward.

In accordance with yet another aspect of the present invention a method is provided for preventing the inadvertent tipping of a floor care cleaning apparatus. The method includes the steps of providing a control handle assembly for the floor care cleaning apparatus that is displaceable between operating and storage positions. The method also includes the step of configuring the handle so that a portion thereof is adjacent the floor when the control handle is in the storage position whereby engagement of the portion with the floor prevents tipping over of the floor care cleaning apparatus. This is a particularly useful feature as it stabilizes the upright vacuum cleaner when the operator is using the wand and tool attachments during cleaning.

The present invention will become readily apparent to those skilled in this art from the following description wherein there is shown and described a preferred embodiment of this invention simply by way of illustration of one of the modes best suited to carry out the invention. As it will be realized, the invention is capable of other different embodiments and it several details are capable of modification in various, obvious aspects all without departing from the invention. Accordingly, the drawings and descriptions will be regarded as illustrative in nature and not as restrictive.

BRIEF DESCRIPTION OF THE DRAWING FIGURES

The accompanying drawings incorporated in and forming a part of the specification, illustrate several aspects of the present invention, and together with the description serve to explain certain principles of the invention. In the drawings:

FIG. 1*a* is a side elevational view of the upright vacuum cleaner of the present invention with the control handle assembly in the operating position;

FIG. 1*b* is a rear elevation view of the upright vacuum cleaner shown in FIG. 1*a;*

FIG. 2*a* is a side elevational view of the upright vacuum cleaner with the control handle assembly in the folded or storage position;

FIG. 2*b* is a rear elevational view of the upright vacuum cleaner shown in FIG. 2*a;*

Reference will now be made in detail to the present preferred embodiment of the invention, an example of which is illustrated in the accompanying drawings.

DETAILED DESCRIPTION OF THE INVENTION

Figure 1A:
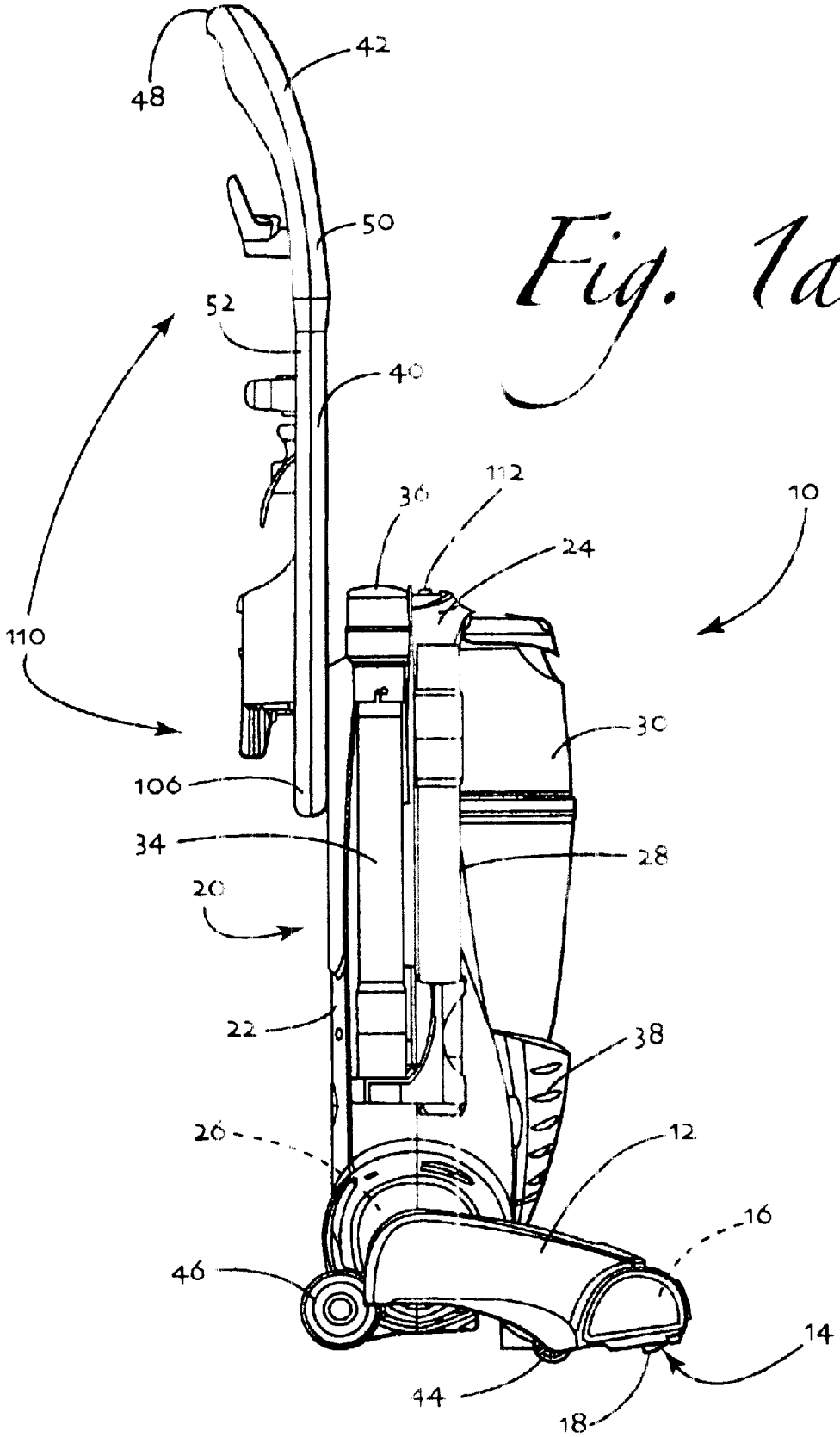
Figure 16:
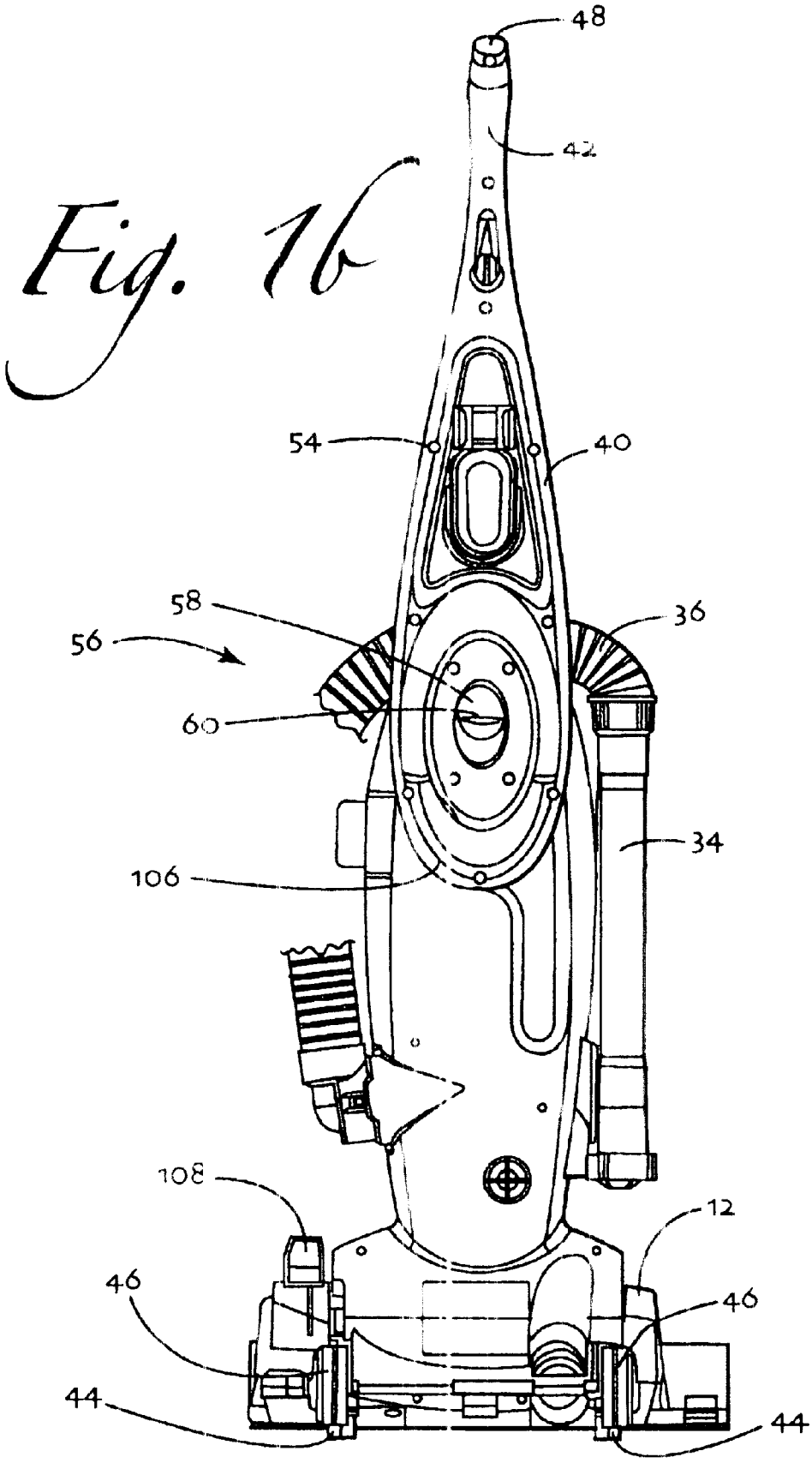

Reference is now made to FIGS. 1*a* and 1*b* illustrating the floor cleaning apparatus 10 of the present invention in the form of an upright vacuum cleaner. The apparatus 10 includes a nozzle assembly 12 that includes an intake opening 14. The nozzle assembly 12 also houses a rotary agitator 16 in the intake opening 14. The rotary agitator 16 may include tufts of bristles 18 or other cleaning structures such as wipers, beater bars and brushes for brushing and beating dirt from the nap of the underlying rug or carpet to be cleaned.

The apparatus 10 further includes a canister assembly, generally designated by reference numeral 20. The canister assembly 20 is pivotally connected to the nozzle assembly 12. The canister assembly 20 includes a first housing section 22 and a second, mating housing section 24. A suction generator 26, including a cooperating fan and drive motor, is housed in a compartment within the canister assembly 20. Additionally, the canister assembly 20 includes a cavity 28 that receives and holds a dirt collection vessel 30. The dirt collection vessel 30 illustrated takes the form of a dirt cup. The dirt cup may include a cylindrical internal chamber and a tangentially directed inlet in order to provide cyclonic airflow and take advantage of the cleaning benefits characteristic of such airflow. As an alternative to the open cavity 28 and cooperating dirt cup, the apparatus 10 may include an enclosed compartment that receives a filter bag in a manner known in the art.

In operation the tufts of bristles 18 on the rotary agitator 16 beat and lift dirt and debris from the nap of an underlying carpet or rug being cleaned. That dirt and debris is drawn into the intake opening 14 in the nozzle assembly 12 by means of the negative pressure and the resulting airflow produced by the suction generator 26. Accordingly, air entrained with dirt and debris is drawn through a conduit (not shown) and delivered through the wand 34 and hose 36 to the inlet (not shown) of the dirt collection vessel 30. Dirt and debris is trapped in the vessel 30 while substantially clean air is drawn through a filter (not shown) into the compartment housing the suction generator 26. That relatively clean air passes over the motor of the suction generator 26 to provide cooling and then is discharged through a final filter (not shown) and the exhaust port 38 into the environment.

A control handle assembly 40 is pivotally connected to the first housing section 22 of the canister assembly 20. More specifically, the control handle assembly 40 is selectively displaceable or pivotable in a transverse plane between the operating position shown in FIGS. 1*a* and 1*b* and the storage position shown in FIGS. 2*a* and 2*b*. In the operating position the operating handle or hand grip 42 is fully extended. This hand grip 42 is held by the operator as the apparatus 10 is manipulated back and forth across the floor to clean the area. Advantageously, the pivotal connection of the canister assembly 20 to the nozzle assembly 12 ensures that the nozzle assembly 12 remains properly oriented on the floor with the rotary agitator 16 in engagement with the underlying rug or carpet being cleaned. The wheels 44 on the nozzle assembly 12 and the wheels 46 on the canister assembly 20 ensure the free and smooth movement of the apparatus 10 over the floor during the cleaning operation.

Figure 2A:
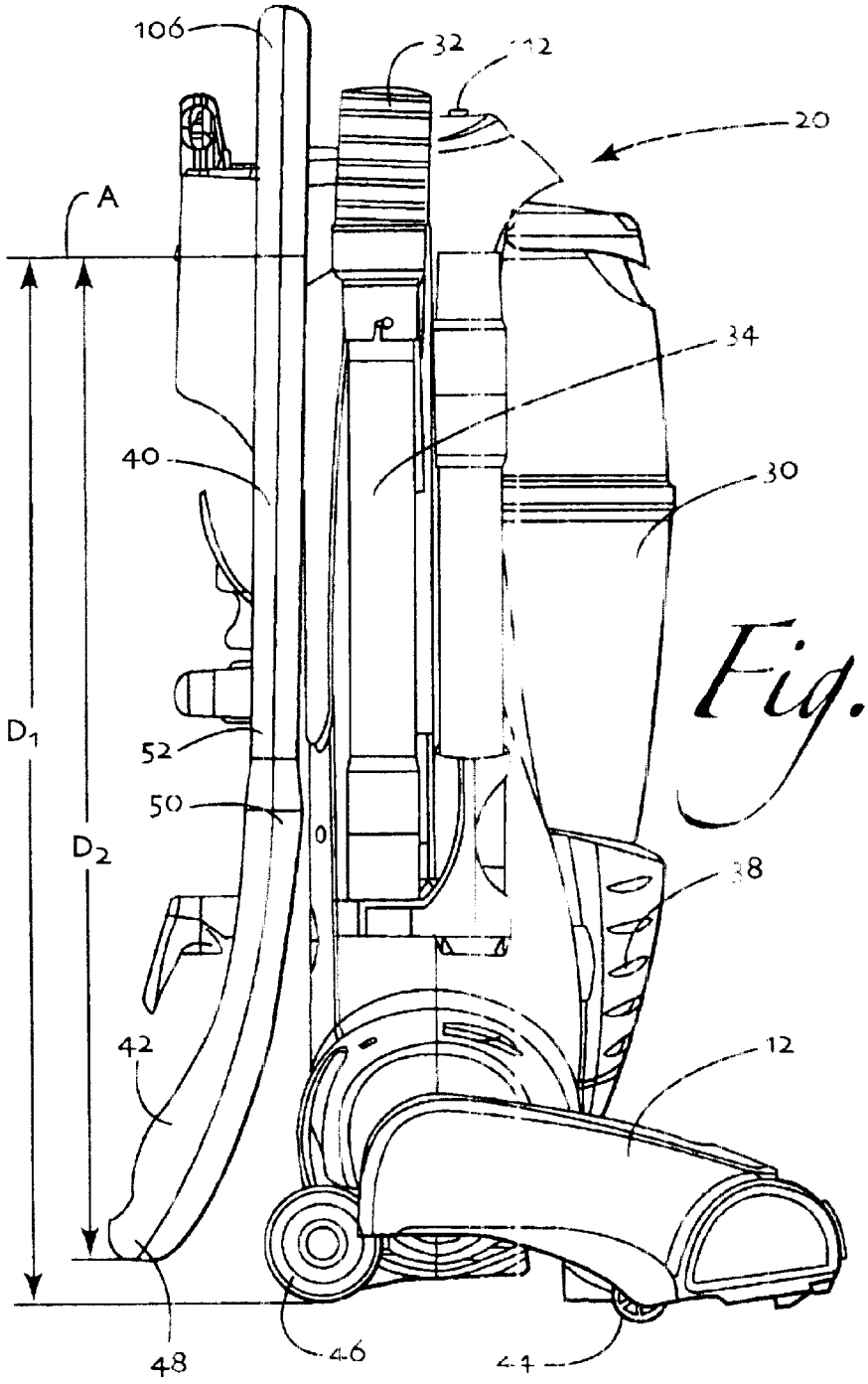
Figure 2B:
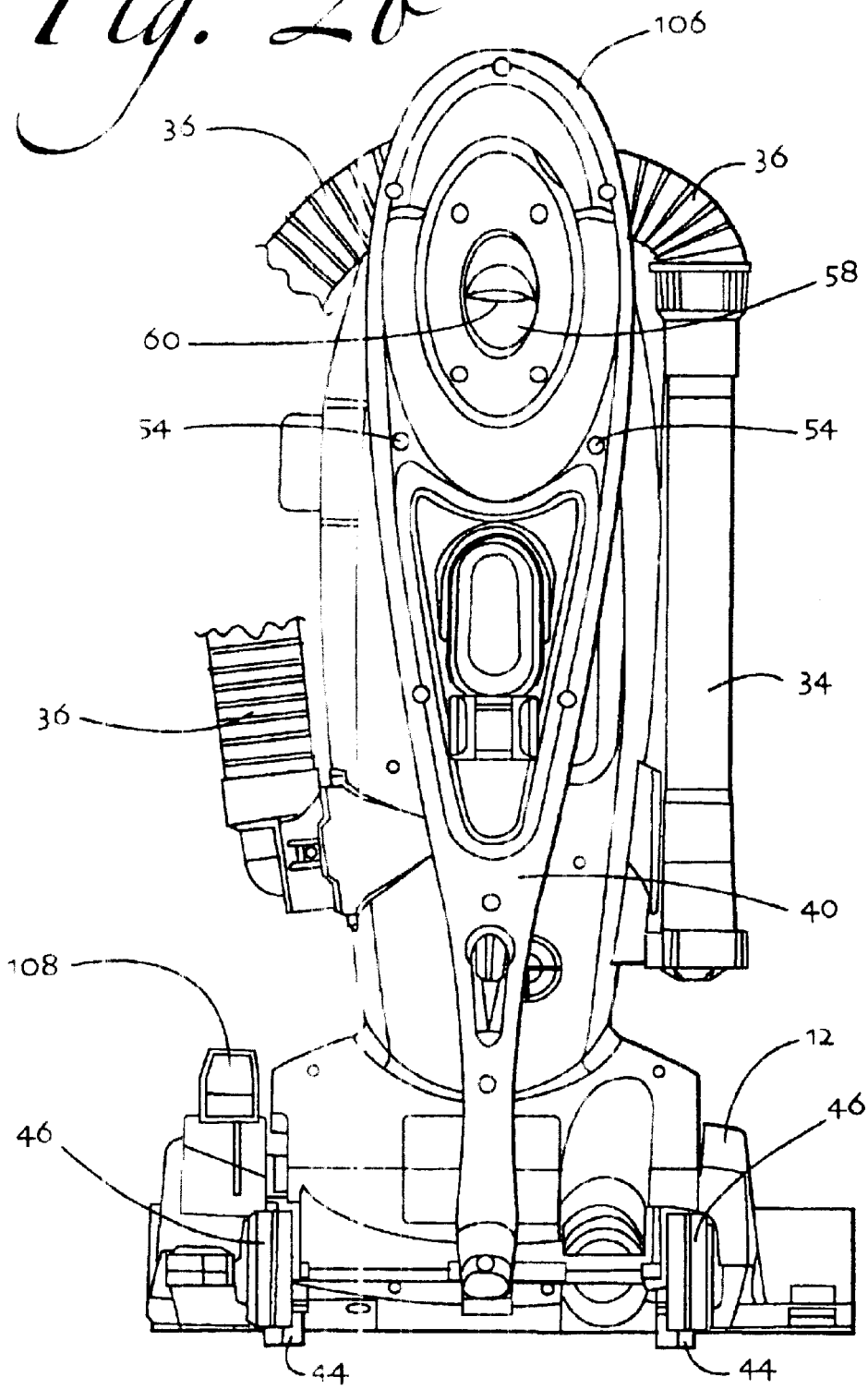

When in the storage position shown in FIGS. 2*a* and 2*b*, the control handle assembly 40 is folded relative to the canister assembly 20 and the resulting lever arm is significantly shortened. In addition, the end or stabilizer 48 at the tip of the hand grip 42 is positioned adjacent the floor. As a consequence of the shortened lever arm, inadvertent contact with the control handle assembly 40 or canister assembly 20 is less likely to produce a sufficient force to tip over the apparatus. Further, in the event the apparatus 10 begins to tip rearwardly toward the control handle assembly 40, the stabilizer 48 engages the floor and prevents the apparatus from tipping over.

Figure 3:
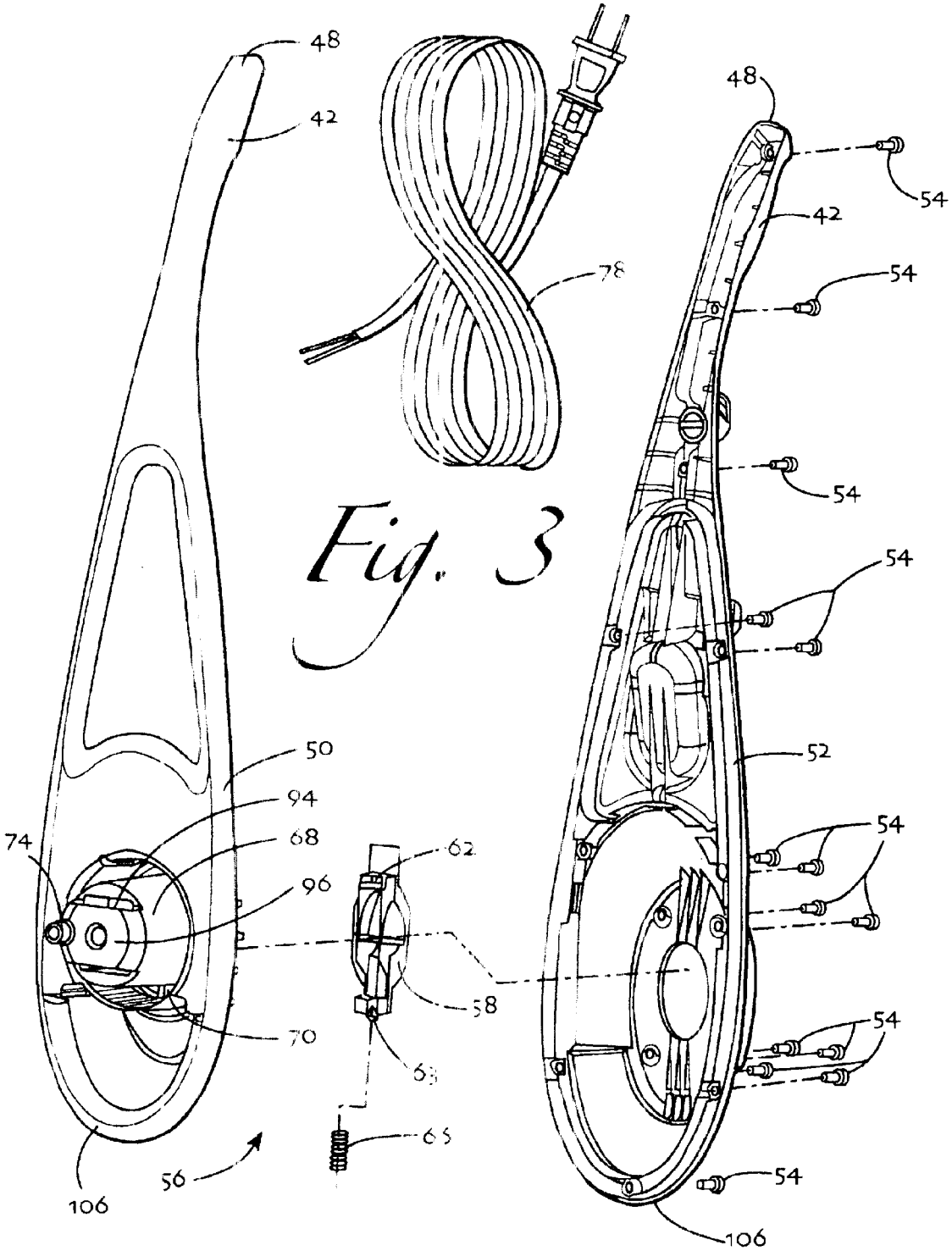
FIG. 3 is an exploded perspective view of the control handle assembly showing the locking mechanism.
Figure 4:
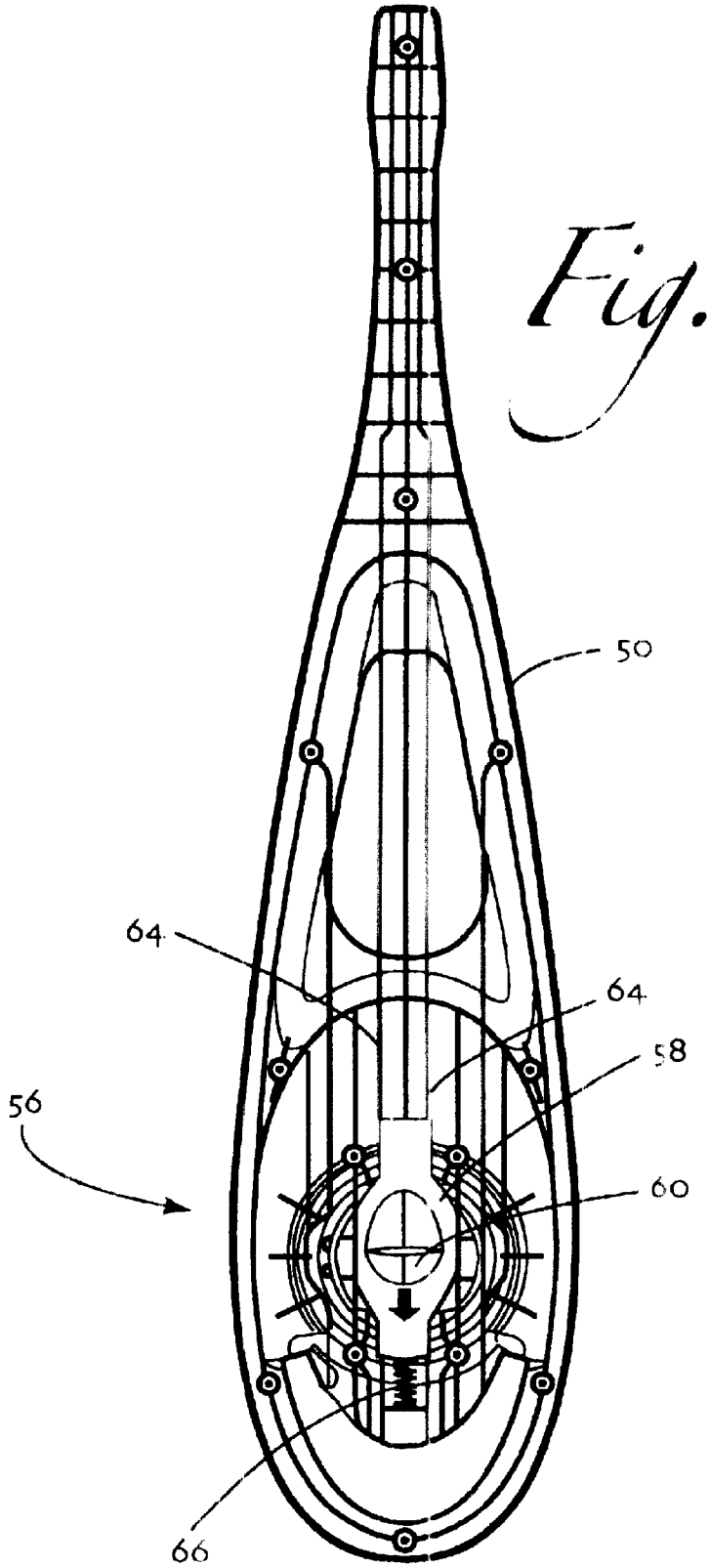
FIG. 4 is a detailed elevational view of the rear section of the control handle assembly showing the seating of the locking mechanism in the guide track and the positioning of the biasing spring.

As best illustrated in FIG. 3, the control handle assembly 40 includes a first housing section 50 and a second housing section 52 that may be secured together by fasteners 54 such as the screws illustrated. A locking mechanism generally designated by reference numeral 56 is captured between the housing sections 50, 52. As illustrated in FIGS. 3 and 4 the locking mechanism 56 includes a body 58 including a touch actuator 60 on one side and both a guide projection 62 and latch 63 on the opposite side. The guide projection 62 and latch 63 are received between the guide ribs 64 on the first housing section 50 with the guide ribs functioning as a guide track. A compression spring 66 seats in a cavity in the housing section 50 and functions as a biasing element to bias the body 58 of the locking mechanism into a latching or locking position which will be described in greater detail below.

Figure 5:
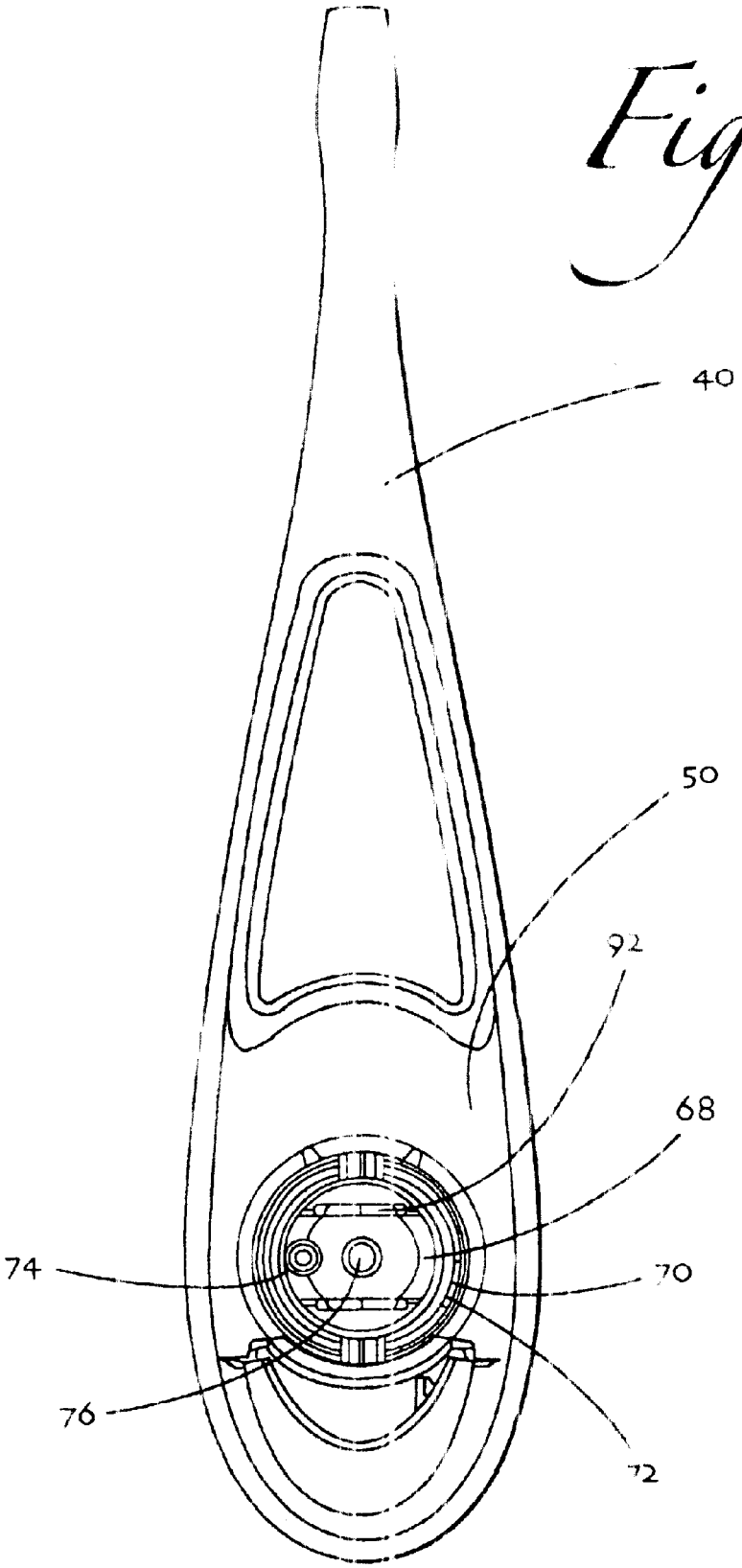
FIG. 5 is a front elevational view of the control handle assembly including the first and second projections.
Figure 8:
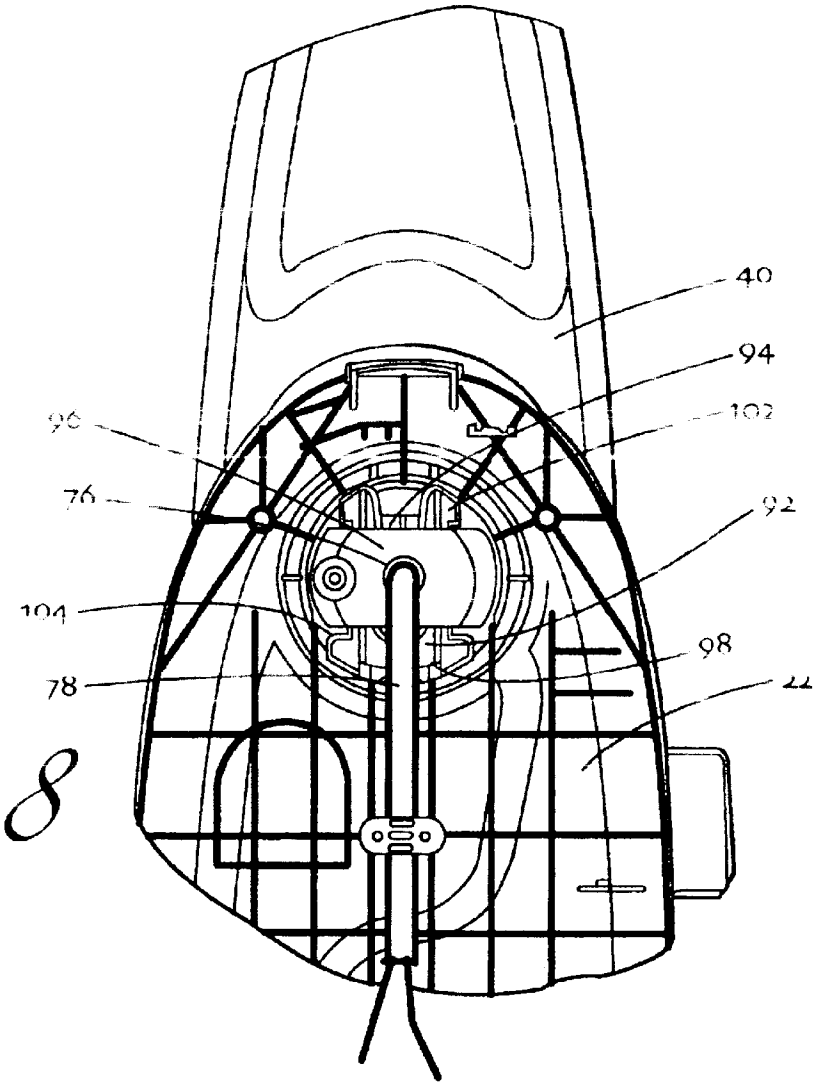
FIG. 8 is a detailed front elevational view showing the retaining clip for securing the control handle assembly to the first section of the canister assembly housing and the routing of the electrical cord through the aperture in the hub of the control handle assembly provided at the pivotal axis of the control handle assembly.

As best illustrated in FIGS. 3 and 5, the first housing section 50 includes a hub 68 that projects outwardly from a surrounding recess 70. A first arcuate projection 72 is positioned at the bottom or base of the recess 70 and a second projection 74 is positioned on the hub 68 a spaced distance from the central aperture 76. The central aperture 76 is positioned substantially on the axis of the pivotal movement of the control handle assembly 40. As illustrated in FIG. 8 the electrical power cord 78 is passed through the aperture 76 so that the control handle assembly 40 may be pivoted between the operating and storage positions without placing any substantial stress on the cord that might damage the cord including the electrical conductors contained therein.

Figure 6:
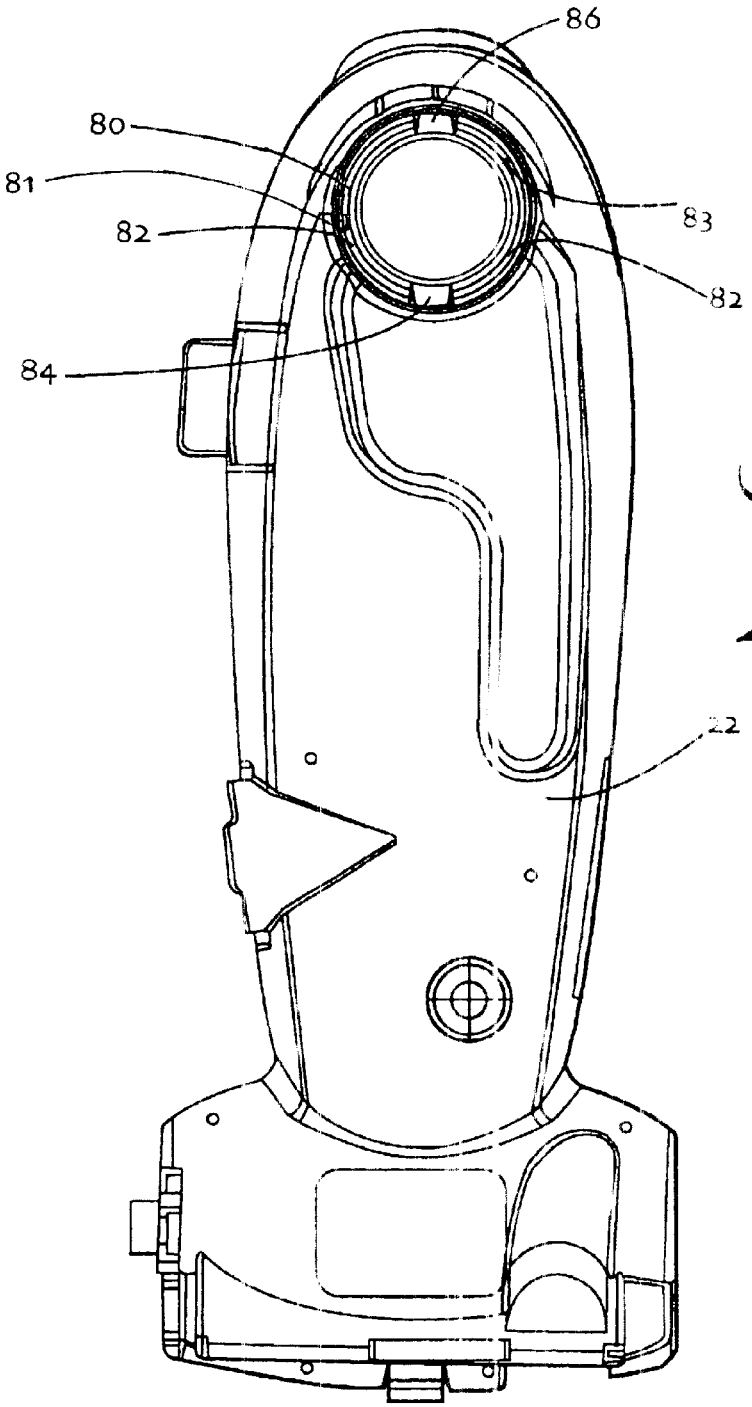
FIG. 6 is a rear elevational view of the first section of the canister assembly housing illustrating the channel for engaging the first projection and the first and second latch receivers for receiving the latch and locking the handle in the operating and storage positions.

As best illustrated in FIG. 6, the first housing section 22 of the canister assembly 20 includes a projecting, open cylindrical boss 80 upon which the control handle assembly 40 is mounted. More specifically, the boss 80 is received in the recess 70 while the hub 68 is received in the boss.

The cylindrical boss 80 includes a channel 82 for receiving the first arcuate projection 72. When the control handle assembly 40 is in the operating position, the first projection 72 engages the first end or stop 81 of the channel 82. In contrast, when the control handle assembly 40 is in the storage position, the first projection 72 engages the second end or stop 83 of the channel 82. When the control handle assembly 40 is being moved between the operating and storage positions, the projection 72 passes freely through the channel 82. The boss 80 also includes a first latch receiving slot 84 for receiving the latch 63 when the control handle assembly 40 is in the operating position and a second latch receiving slot 86 for receiving the latch when the control handle assembly is in the storage position.

Figure 7:
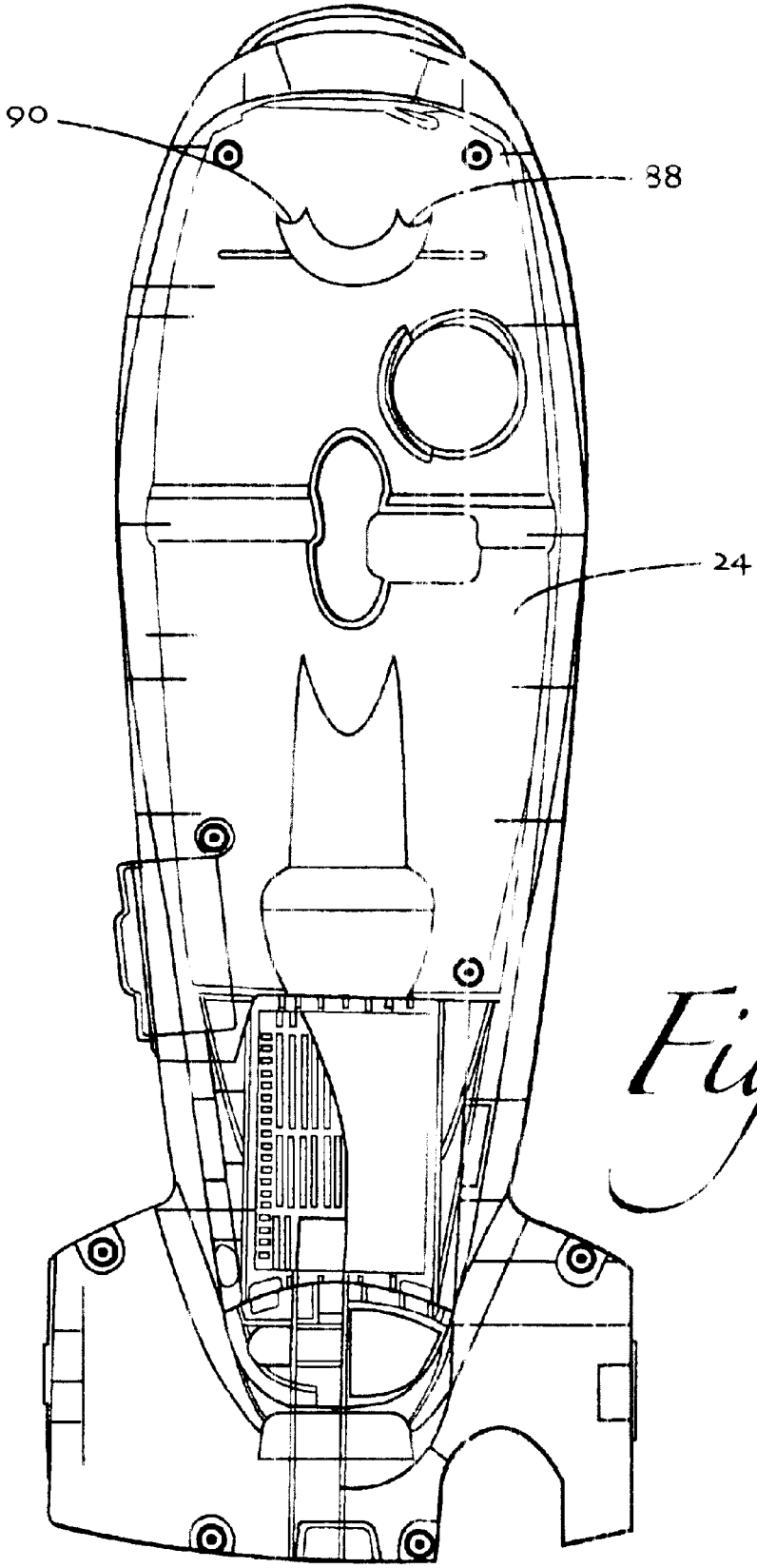
FIG. 7 is an elevational view of the inside of the second section of the canister assembly housing illustrating first and second ribs for engaging the second projection and limiting the control handle assembly to a substantially 180 degree arc of pivotal motion between the operating and storage positions.

As illustrated in FIG. 7, the second housing section 24 of the canister assembly 20 includes first and second ribs or tabs 88, 90 respectively. The first rib 88 engages the second projection 74 when the control handle assembly 40 is in the operating position. In contrast, the second rib 90 engages the second projection 74 when the control handle assembly 40 is in the storage position. Thus, it should be appreciated that the first projection 72 and the cooperating ends or stops 81 and 83 of the channel 82 function together with the second projection 74 and the cooperating ribs 88, 90 to limit the motion of the control handle assembly 40 relative to the canister assembly 20 to an arc of substantially 180 degrees between the operating position shown in FIGS. 1*a* and 1*b* and the storage position shown in FIGS. 2*a* and 2*b*.

Figure 8A:
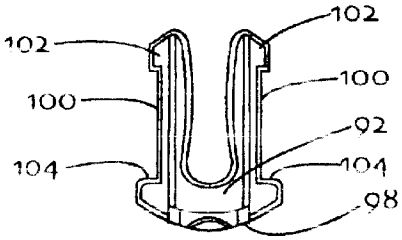
FIG. 8*a* is a front elevational view of the retaining clip.

As best illustrated in FIGS. 8 and 8*a*, a retaining clip 92 secures the control handle assembly 40 to the first housing section 22 of the canister assembly 20. More particularly, the hub 68 of the control handle assembly 40 includes a projecting wall structure 96 that defines a slot 94 for receiving the retaining clip 92. As best shown in FIG. 8*a*, the retaining clip includes an enlarged head 98 at one end and a pair of resilient legs 100 with hooks 102 at the opposite end. With the hub 68 fully seated in the boss 80, the retaining clip 92 is inserted in the slot 94 by compressing the legs 100 together and pushing them through the slot. When the retaining clip 92 is properly seated, the shoulders 104 on the head 98 of the clip engage the wall structure 96 on one side while the hooks 102 engage the wall structure 96 on the opposite side; the resilient memory of the legs 100 ensuring that the legs expand back apart so that the hooks are brought into engagement with the wall structure. Simultaneously, the face of the clip 92 spans the boss 80 thereby engaging the edge thereof and preventing the hub 68 from being pulled back out of the boss 80.

As best illustrated in FIG. 2*b*, the control handle assembly 40 of the present invention includes a carrying handle or loop portion 106 at a second end thereof opposite the hand grip 42 at the other end. When the control handle assembly 40 is in the storage position the carrying handle 106 is easily and conveniently grasped to lift the apparatus 10 and carry it to a desired location, such as a carpet area to be cleaned.

Upon arriving at the work location, the touch actuator 60 is pushed upward to move the body 58 of the locking mechanism 56 against the biasing spring 66. As a result, the latch 63 is displaced from the second latch receiving slot 86. The control handle assembly 40 may then be pivoted through an axis of approximately 180 degrees in order to bring the control handle assembly into the operating position shown in FIGS. 1*a* and 1*b*. Upon reaching the operating position, the biasing spring 66 biases the body 58 of the locking mechanism 56 to bring the latch 63 into engagement with the first latch receiving slot 84 thereby locking the assembly in position.

During the movement of the control handle assembly 40 between the storage and operating positions, the second projection 74 moves through an arc from engagement with the first rib 88 into engagement with the second rib 90. Similarly, the first projection 72 moves along the channel 82 from engagement with the second end or stop 83 of the channel into engagement with the first end or stop 81 of the channel. Together the projections 72, 74, ribs 88, 90 and channel 82 limit the movement of the control handle assembly 40 through a defined arc of approximately 180 degrees. Once in the operating position the engagement of the latch 63 in the first latch receiving slot 84 functions to lock the control handle assembly 40 in the operating position.

The electrical power cord 78 of the apparatus 10 may then be plugged into an electrical wall outlet and the actuator switch 112 manipulated to energize the motor of the suction generator 26 thereby creating cleaning suction and rotating the rotary agitator 16. The foot latch 108 is then depressed to unlock the canister assembly 20 from the storage position and allow free pivoting movement of the canister assembly with respect to the nozzle assembly 12 during the cleaning operation.

Following cleaning, the control handle assembly 40 is latched in the upright, storage position shown in FIGS. 1*a* and 1*b*. The electric power cord 78 is unplugged from the electrical wall outlet and the cord is again wrapped around the cord holder, generally designated by reference numeral 110. The touch actuator 60 is then depressed downwardly to release the latch 68 from the first latch receiving slot 84. The control handle assembly 40 is then pivoted relative to the nozzle assembly 20 so that the first projection 72 rides through the channel 82 from the first end 81 to the second end 83. Simultaneously, the second projection 74 travels from engagement with the first rib 82 to the second rib 90. Once the control handle assembly 40 reaches the storage position shown in FIGS. 2*a* and 2*b*, the biasing spring 66 biases the body 58 of the locking mechanism so that the latch 63 enters the second latch receiving slot 86. This functions to lock the control handle assembly 40 in the storage position. The operator then grabs the apparatus 10 by means of the carrying handle 106 and places the apparatus in the storage location.

As should be appreciated, the distance $D_2$ from the tip or stabilizer 48 to the pivotal axis A of the control handle assembly 40 is only slightly less than the distance from the pivotal axis A to the floor or bottom of the apparatus 10. The total difference in the lengths $D_1$ and $D_2$ is only about 0.5 to about 2.0 cm. Thus, it should be appreciated that the tip or stabilizer 48 is provided directly adjacent to the floor. Further, the tip or stabilizer 48 is provided at a position about four inches behind the axles of the rear wheels 46 on the canister assembly 20. This set back functions to provide a more stable base for the vacuum cleaner 10. Accordingly, in the event the apparatus 10 is inadvertently bumped or pushed so as to tip rearwardly, the stabilizer 48 engages the floor and prevents the apparatus from falling over rearward. Advantageously, rearward tipping of state of the art upright vacuum cleaners is a common and frustrating problem that is addressed and successfully prevented with the upright vacuum cleaner designed in accordance with the present invention.

It, of course, should also be appreciated that the storage position of the handle is also particularly useful when the operator is engaged in above floor cleaning using the wand and any appropriate tools or attachments. More specifically, the stabilizer 48 is in immediate proximity to the floor and thereby stabilizes the vacuum cleaner against tipping. In addition, the carrying handle 106 is located at a convenient position and height where it may be readily grasped by the operator to move or adjust the positioning of the vacuum cleaner on the floor as may be necessary to complete the cleaning task at hand.

The foregoing description of the preferred embodiment of the invention has been presented for purposes of illustration and description. It is not intended to be exhaustive or to limit the invention to the precise form disclosed. Obvious modifications or variations are possible in light of the above teachings For example, while the hub 68, latch 63 and projections 72, 74 are provided on the control handle assembly 40 and the boss 80, channel 82, stops 81, 83 and ribs 88, 90 are provided on the canister assembly 20 in the illustrated embodiment, these structures could just as easily be reversed if desired.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiment do not and are not intended to limit the ordinary meaning of the claims and their fair and broad interpretation in any way.

What is claimed is:

1. A floor care cleaning apparatus, comprising:

a nozzle assembly having an intake opening;

a canister assembly pivotally connected to said nozzle assembly;

a suction generator carried on one of said nozzle assembly and said canister assembly;

a dirt collection vessel carried on one of said nozzle assembly and said canister assembly; and a control handle assembly pivotally connected to said canister assembly, said control handle assembly having an operating handle adjacent a first end and a carrying handle adjacent a second end, said control handle assembly being selectively displaceable between an operating position and a storage position.

2. The floor care cleaning apparatus of claim 1 further including a hub on one of said canister assembly and said control handle assembly and a boss engaging said hub on the other of said canister assembly and said control handle assembly.

3. The floor care cleaning apparatus of claim 2 further including a first projection on one of said canister assembly and said control handle assembly and a first projection receiver on the other of said canister assembly and said control handle assembly.

4. The floor care cleaning apparatus of claim 3, wherein said first projection receiver includes a first stop engaging said first projection when said control handle assembly is in said operating position and a second stop engaging said first projection when said control handle assembly is in said storage position.

5. The floor care cleaning apparatus of claim 4, wherein said first projection receiver is a channel extending in a limited arc radially around an axis about which said control handle assembly pivots with respect to said canister assembly.

6. The floor care cleaning apparatus of claim 5, further including a locking mechanism for locking said control handle assembly in said operating position or said storage position.

7. The floor care cleaning apparatus of claim 6, wherein said locking mechanism includes a guide track carried on one of said canister assembly and said control handle assembly and a displaceable latch received in said guide track.

8. The floor care cleaning apparatus of claim 7, further including a first latch receiver receiving said latch when said control handle assembly is in said operating position and a second latch receiver receiving said latch when said control handle assembly is in said storage position, said first and second latch receivers being carried on the other of said canister assembly and said control handle assembly.

9. The floor care cleaning apparatus of claim 8, further including a means for biasing said latch into one of said first and second latch receivers.

10. The floor care cleaning apparatus of claim 9, further including a slot carried by said hub and a retaining clip received in said slot to retain said control handle assembly and said canister assembly together.

11. The floor care cleaning apparatus of claim 9, further including a second projection on one of said canister assembly and said control handle assembly and a second projection receiver on the other of said canister assembly and said control handle assembly.

12. The floor care cleaning apparatus of claim 11, wherein said second projection receiver includes a first rib engaging said second projection when said control handle assembly is in said operating position and a second rib engaging said second projection when said control handle assembly is in said storage position.

13. The floor care cleaning apparatus of claim 12, further including an aperture in said hub substantially on said axis.

14. The floor care cleaning apparatus of claim 13, further including an electrical power cord extending through said aperture.

15. The floor care cleaning apparatus of claim 12, wherein said first projection is carried on said control handle assembly.

16. The floor care cleaning apparatus of claim 15, wherein said second projection is carried on said control handle assembly.

17. The floor care cleaning apparatus of claim 1, wherein said operating handle is a hand grip.

18. The floor care cleaning apparatus of claim 1, wherein said carrying handle comprises a portion of a loop.

19. A floor care cleaning apparatus, comprising:

a nozzle assembly having an intake opening;

a canister assembly connected to said nozzle assembly;

a suction generator carried on one of said nozzle assembly and said canister assembly;

a dirt collection vessel carried on one of said nozzle assembly and said canister assembly; and a control handle assembly pivotally connected to said canister assembly, said control handle assembly having an operating handle adjacent a first end and a carrying handle adjacent a second end, said control handle assembly being selectively displaceable between an operating position and a storage position wherein said control handle pivots relative to said canister assembly about an axis A, said axis A being a distance $D_1$ from a bottom of said floor cleaning apparatus and said operating handle includes a stabilizer, said stabilizer being a distance $D_2$ from said axis A wherein $D_2$ is less than $D_1$ by about 0.5 to about 2.0 cm.

20. The floor cleaning apparatus of claim 19, wherein at least one wheel is carried on an axle on said canister assembly and said stabilizer is spaced rearwardly from said axle by a distance of about four inches when said control handle is in said storage position.

21. A floor cleaning apparatus, comprising:

a housing;

a suction generator and a dirt collection vessel carried on said housing;

a control handle assembly pivotally connected to said housing, said control handle assembly including a hand grip and a stabilizer for engaging a floor when storing said floor cleaning apparatus.

22. A method for preventing the inadvertent tipping of a floor cleaning apparatus, comprising:

providing a control handle assembly for a floor cleaning apparatus that is displaceable between operating and storage positions; and configuring said control handle assembly so that a portion thereof is adjacent the floor when said control handle assembly is in said storage position whereby engagement of said portion with the floor prevents tipping over of said floor care cleaning apparatus.

* * * * *